US010821487B2

(12) United States Patent
Chen et al.

(10) Patent No.: US 10,821,487 B2
(45) Date of Patent: Nov. 3, 2020

(54) CLEANING APPARATUS FOR CONCENTRATION CONTROLLER OF COATING MACHINE

(71) Applicants: Chi-Ming Chen, Taichung (TW); Yi-Nung Chung, Changhua (TW)

(72) Inventors: Chi-Ming Chen, Taichung (TW); Yi-Nung Chung, Changhua (TW)

( * ) Notice: Subject to any disclaimer, the term of this patent is extended or adjusted under 35 U.S.C. 154(b) by 69 days.

(21) Appl. No.: 16/230,709

(22) Filed: Dec. 21, 2018

(65) Prior Publication Data

US 2020/0197986 A1 Jun. 25, 2020

(51) Int. Cl.
*B08B 9/032* (2006.01)
*B08B 5/00* (2006.01)
*B08B 9/055* (2006.01)

(52) U.S. Cl.
CPC ..... *B08B 9/0326* (2013.01); *B08B 5/00* (2013.01); *B08B 9/0553* (2013.01); *B08B 2220/01* (2013.01); *B08B 2220/04* (2013.01)

(58) Field of Classification Search
CPC ..... B08B 9/0326
See application file for complete search history.

(56) References Cited

U.S. PATENT DOCUMENTS 5,674,323 A * 10/1997 Garcia ..... B08B 3/12 134/1
7,421,757 B1 * 9/2008 Garcia, Jr. ..... B05B 1/083 15/304
7,510,662 B1 * 3/2009 Hansen ..... F01P 11/06 134/102.2

* cited by examiner

*Primary Examiner* — Jason Y Ko
(74) *Attorney, Agent, or Firm* — Che-Yang Chen; Law Office of Michael Chen

(57) ABSTRACT

A cleaning apparatus for concentration controller of coating machine may include a pulse bubble generator and a container used for cleaning a concentration controller of a coating machine and a tube thereof. The pulse bubble generator has a bubble-generating end connected to the container through a pipe, and the container is filled with a plentiful detergent. The pulse bubble generator is configured to pump air into the detergent with a pulse per time, and a large amount of detergent bubbles are adapted to be generated in the container. The detergent bubbles are configured to be pumped by the concentration controller into the tube and the concentration controller so as to complete cleaning effect of the tube and the concentration controller.

2 Claims, 7 Drawing Sheets

CLEANING APPARATUS FOR CONCENTRATION CONTROLLER OF COATING MACHINE

FIELD OF THE INVENTION

The present invention relates to a cleaning apparatus and more particularly to a cleaning apparatus for concentration controller of coating machine that can complete cleaning effect with a small amount of detergent.

BACKGROUND OF THE INVENTION

Generally, a concentration controller (20) of a coating machine (10) is used to control the mixing ratio of ingredients such as mixing of ink and glue to produce a coating solution (30) in a designed ratio, and the mixing process is proceeded in a solvent bucket (21), and through the concentration controller (20), the mixed coating solution (30) having designed concentration and viscosity is configured to send into a printing machine or the coating machine (10) to achieve the process of ink printing or automatic gluing (as shown in FIG. 1).

However, the conventional cleaning apparatus has following disadvantages: (i) when the process of ink printing or automatic gluing is completed, in order to prevent the coating solution (30) from remaining in the concentration controller (20) and a tube (22) thereof and becoming hardened so as to cause jam, a number amount of liquid detergent is adapted to be pumped into the concentration controller (20) through the tube (22) for thorough cleaning, which is costly and causes great environmental burden when the wasted detergent solution needs to be processed thereafter. Therefore, there remains a need for a new and improved design for a cleaning apparatus for concentration controller of coating machine to overcome the problems presented above.

SUMMARY OF THE INVENTION

The present invention provides a cleaning apparatus for concentration controller of coating machine which comprises a pulse bubble generator and a container used for cleaning a concentration controller of a coating machine and a tube thereof. The pulse bubble generator has a bubble-generating end connected to the container through a pipe, and the container is filled with a plentiful detergent. The pulse bubble generator is configured to pump air into the detergent with a pulse per time such as per second, and a large amount of detergent bubbles are adapted to be generated in the container. The detergent bubbles are configured to be pumped by the concentration controller into the tube and the concentration controller so as to complete cleaning effect of the tube and the concentration controller.

Comparing with conventional cleaning way for concentration controller of coating machine, the present invention is advantageous because: (i) the volume of the detergent bubbles is several times larger than the detergent such that the cleaning process only needs a small amount of detergent to complete the full cleaning; and (ii) after cleaning, the concentration controller is configured to pump the detergent bubbles back into the container so as to enable the detergent to be reused.

DETAILED DESCRIPTION OF THE INVENTION

Figure 1:
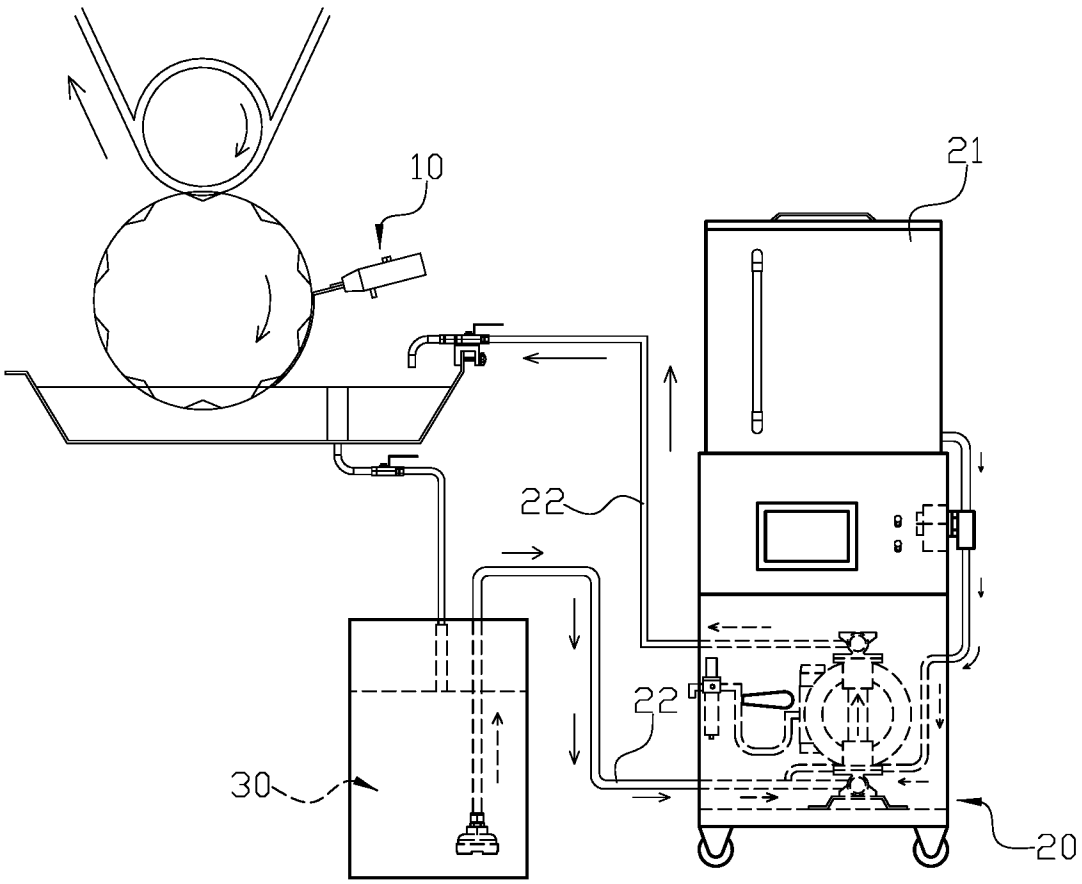
FIG. 1 is a schematic view illustrating a concentration controller sends a plentiful coating solution into a coating machine in the present invention.
Figure 2:
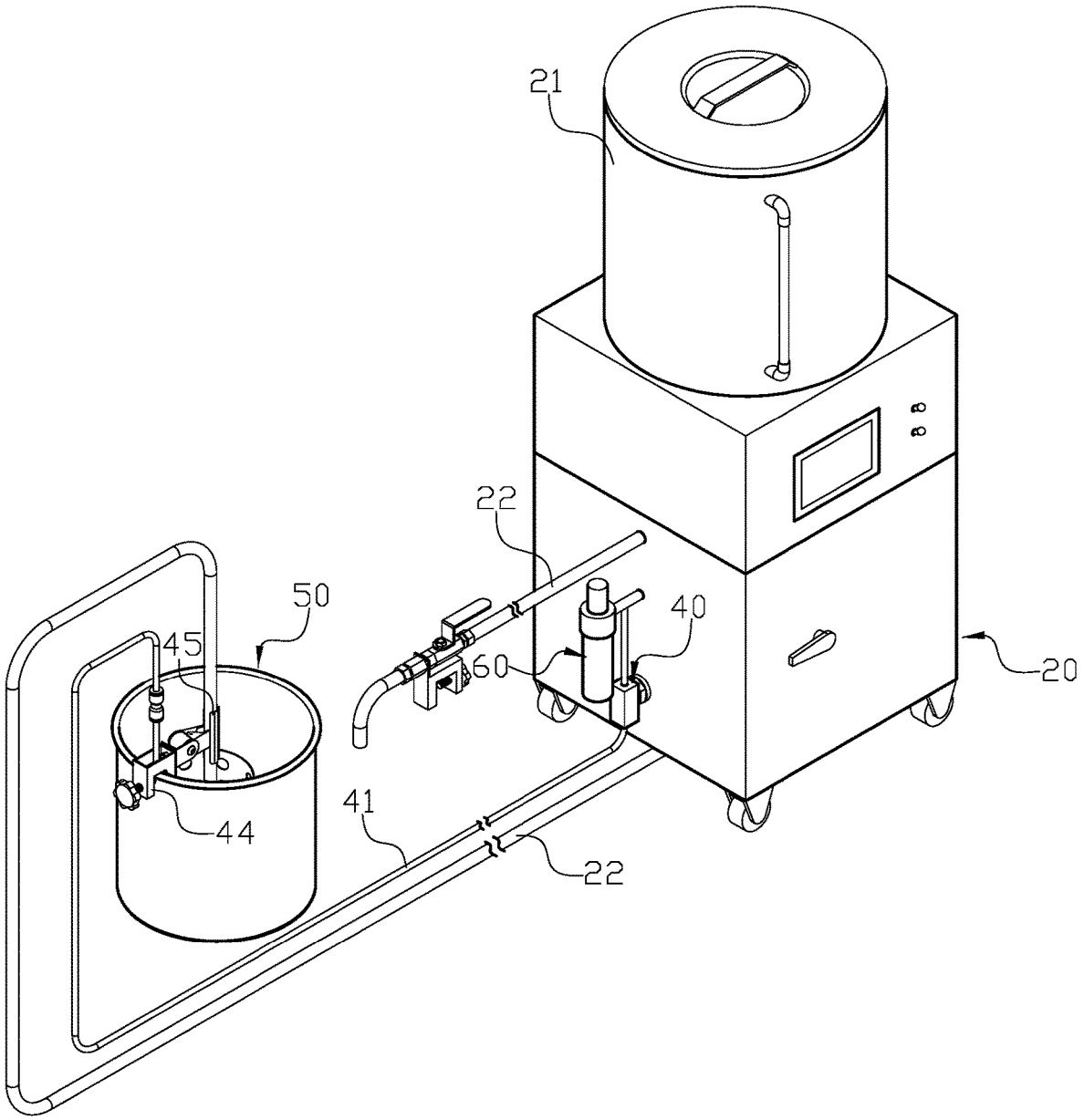
FIG. 2 is a three-dimensional assembly view of a cleaning apparatus of the present invention applied to the concentration controller of the coating machine in the present invention.
Figure 3:
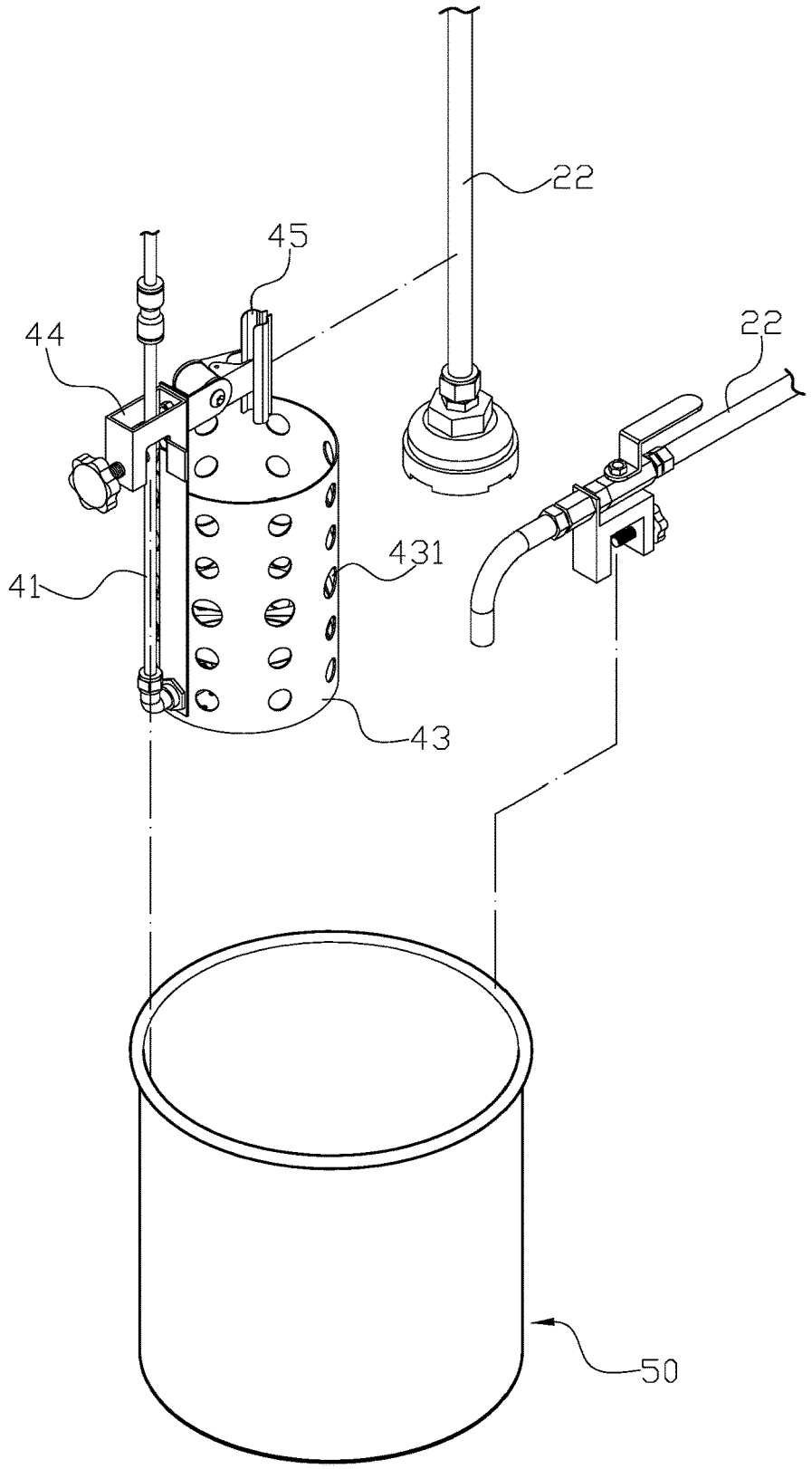
FIG. 3 is a detailed exploded view of the cleaning apparatus of the present invention.
Figure 4:
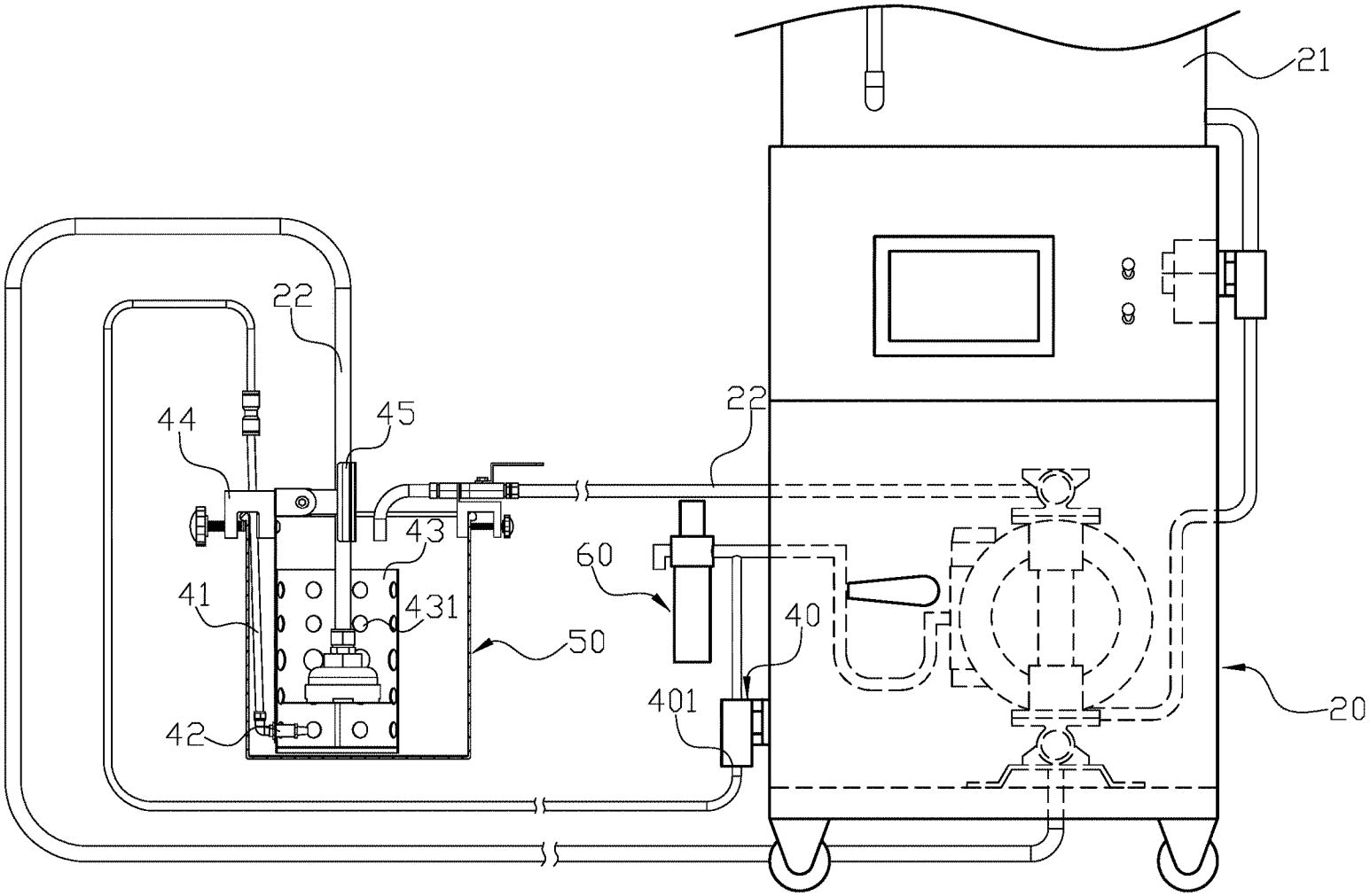
FIG. 4 is a plane diagram of the cleaning apparatus of the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 2 to 7, the present invention provides a cleaning apparatus for concentration controller of coating machine which comprises a pulse bubble generator (40) having a bubble-generating end (401), and the bubble-generating end (401) is connected to a container (50) through a pipe (41), and the container (50) is filled with a plentiful detergent (51). The pulse bubble generator (40) is configured to pump air into the detergent (51) with a pulse per time such as per second, and a large amount of detergent bubbles (510) are adapted to be generated in the container (50). The detergent bubbles (510) are configured to be pumped by the concentration controller (20) into the tube (22) and the concentration controller (20) so as to complete cleaning effect of the tube (22) and the concentration controller (20). After bubbling to become detergent bubbles (510), the volume of the detergent (51) is adapted to expand several times such that the cleaning process of the present invention only needs a small amount of detergent (51) to complete the full cleaning. Also, after cleaning, the concentration controller (20) is configured to pump the detergent bubbles (510) back into the container (50) so as to enable the detergent (51) to be reused.

In one embodiment, an end of the pipe (41) penetrating in the container (50) is connected to a spray head (42), and the spray head (42) is adapted to evenly send air into the container (50).

In another embodiment, the end of the pipe (41) penetrating in the container (50) is connected to the spray head (42), and the spray head (42) is secured on a cylinder support (43) which has a plurality of through holes (431) on an outer periphery thereof.

In still another embodiment, a clamping member (44) is connected on the pipe (41), and the pipe (41) is secured on an outer periphery of an opening of the container (50) through the clamping member (44).

In a further embodiment, a holding member (45) is connected on the pipe (41) and is configured to hold the tube (22) of the concentration controller (20).

In still a further embodiment, the pulse bubble generator (40) is connected to an air filter (60) to filter the air, and the filtered air is pumped through the pipe (41) into the detergent (51) with a pulse per time.

In a particular embodiment, the pulse bubble generator (40) together with the air filter (60) is directly secured on the concentration controller (20).

Figure 5:
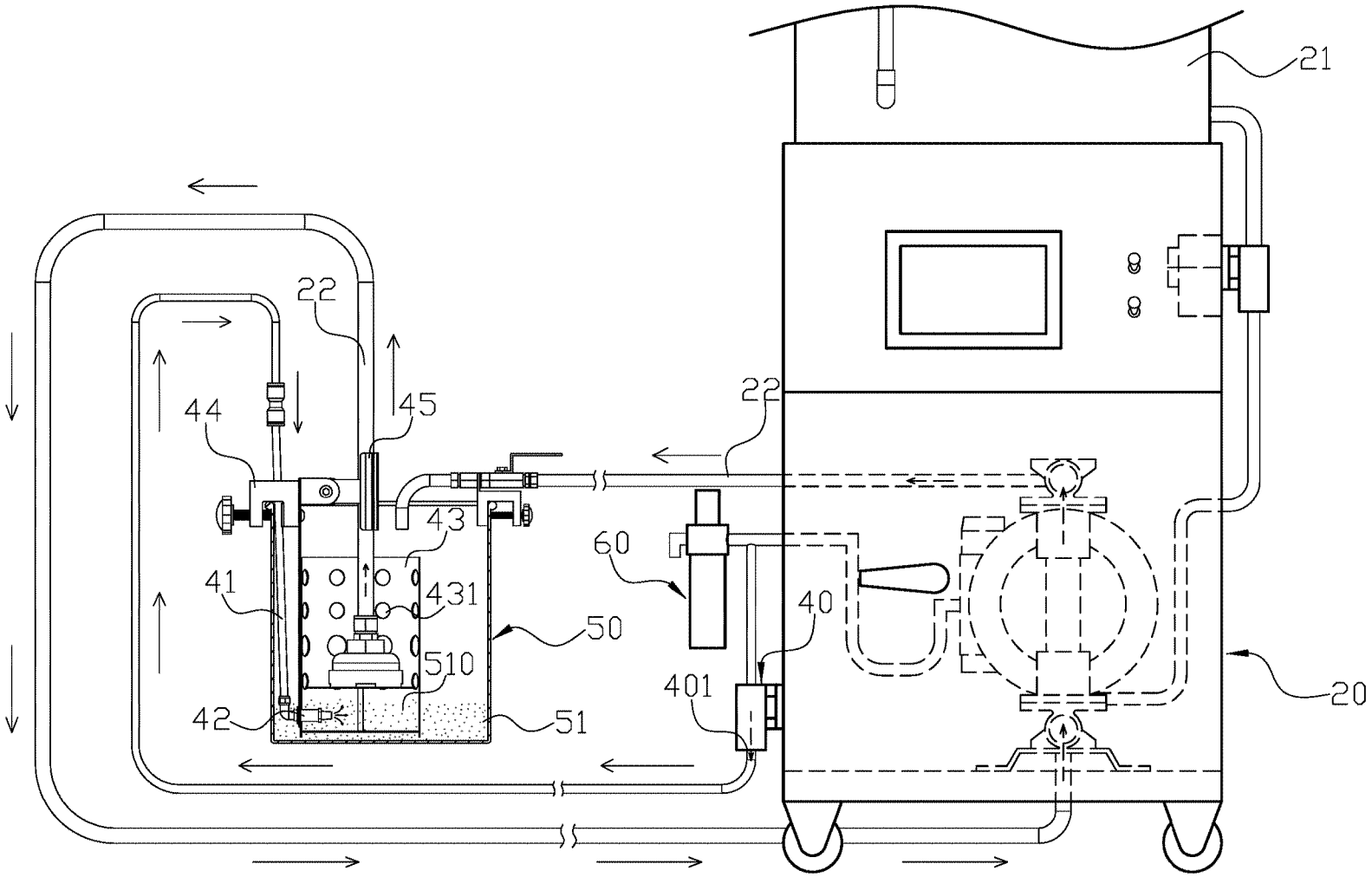
FIG. 5 is a schematic view illustrating the cleaning apparatus of the present invention is in use.
Figure 6:
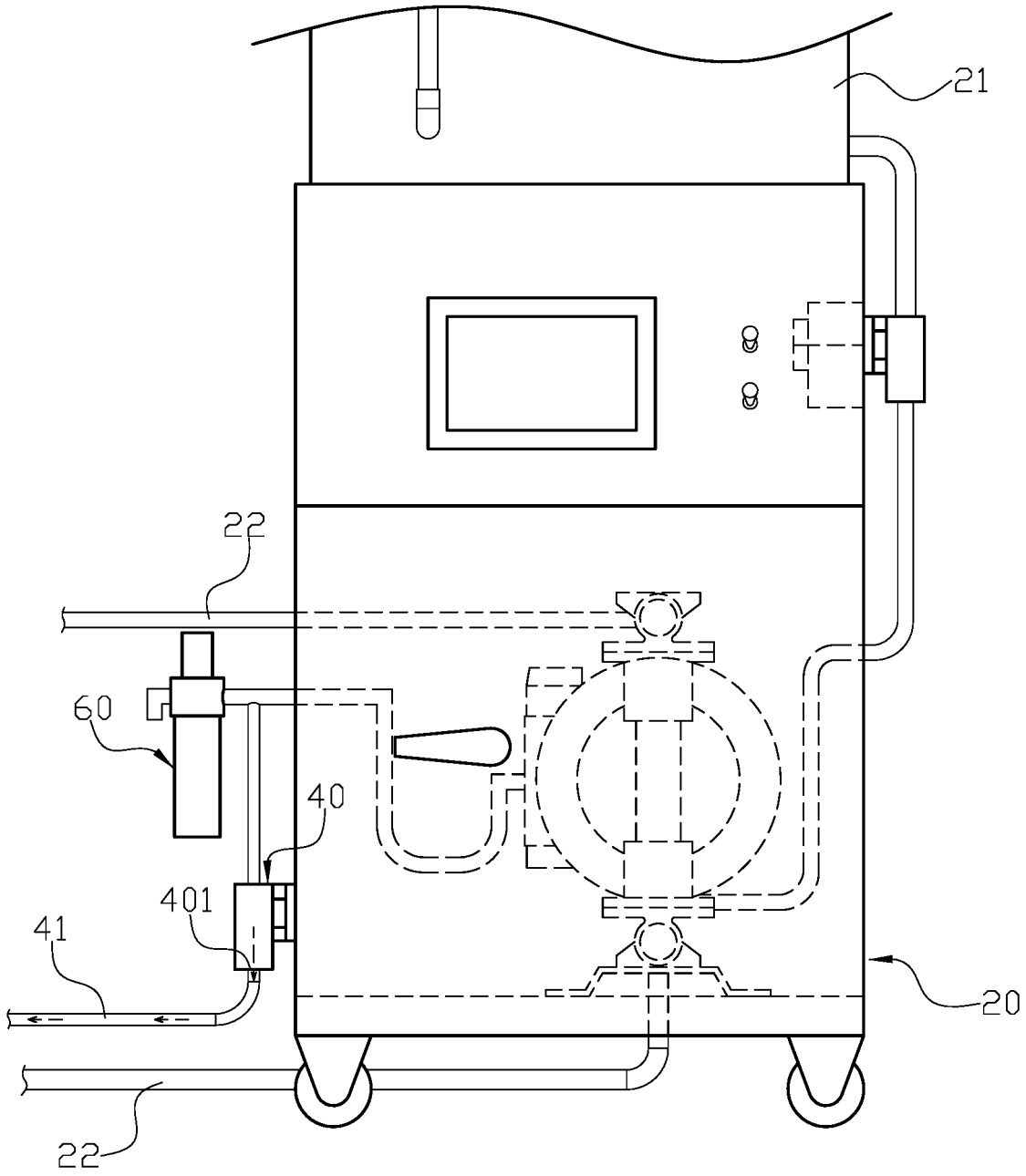
FIG. 6 is a schematic view illustrating a pulse bubble generator of the cleaning apparatus of the present invention is working.
Figure 7:
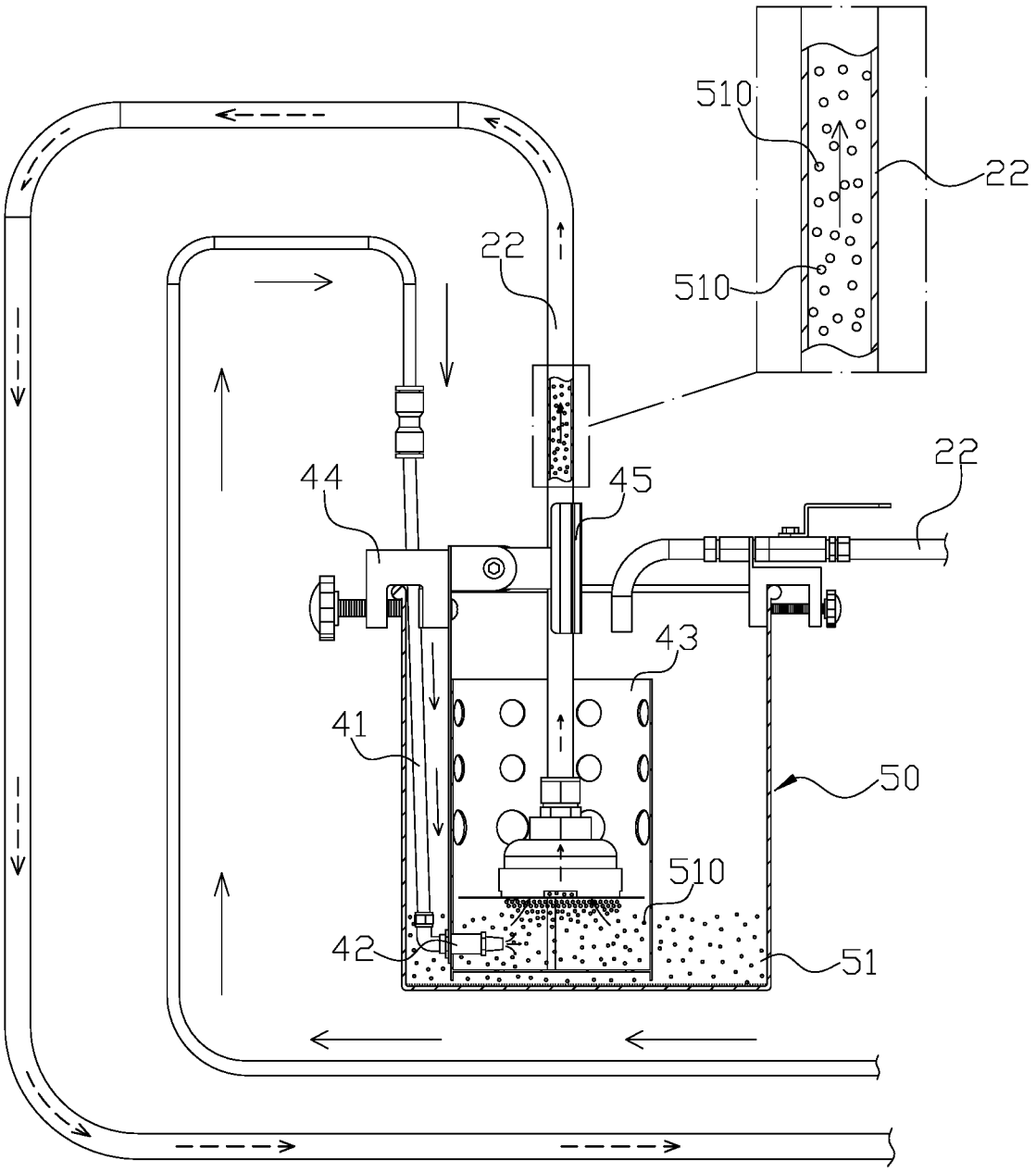
FIG. 7 is a partial enlarged sectional view illustrating a plurality of detergent bubbles are pumped into a tube of the concentration controller of the coating machine in the present invention.

The concentration controller (20) of the coating machine (10) is used to control the mixing ratio of ingredients such as mixing of ink and glue to produce the coating solution (30) in a designed ratio, and the mixing process is proceeded in the solvent bucket (21), and through the concentration controller (20), the mixed coating solution (30) having designed concentration and viscosity is configured to send into a printing machine or the coating machine (10) to achieve the process of ink printing or automatic gluing (as shown in FIG. 1). When the process of ink printing or automatic gluing is completed, in order to prevent jam in the tube (22) and the concentration controller (20) due to remaining coating solution (30), the detergent (51) is bubbled to become the detergent bubbles (510) by the pulse bubble generator (40), and the detergent bubbles (510) are pumped into the tube (22) and the concentration controller (20) (as shown in FIGS. 5 to 7). Since the volume of the detergent bubbles (510) is several times larger than the detergent (51), the cleaning process of the present invention only needs a small amount of the detergent (51) to complete the full cleaning, which reduces cleaning cost and also alleviates hazards to environment.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A cleaning apparatus for concentration controller of coating machine comprising a pulse bubble generator and a container used for cleaning a concentration controller of a coating machine and a tube thereof, wherein the pulse bubble generator has a bubble-generating end connected to the container through a pipe, and the container is filled with a predetermined amount of detergent; the pulse bubble generator is configured to pump air into the detergent with a pulse per time, and a number of detergent bubbles are adapted to be generated in the container; the detergent bubbles are configured to be pumped by the concentration controller into the tube and the concentration controller so as to complete cleaning effect of the tube and the concentration controller; the volume of the detergent bubbles is several times larger than the detergent such that the cleaning process only needs a small amount of detergent to complete the full cleaning; after completing cleaning process, the concentration controller is configured to pump the detergent bubbles back into the container so as to enable the detergent to be reused; an end of the pipe penetrating in the container is connected to a spray head, and the spray head is secured on a support which has a plurality of through holes on an outer periphery thereof; a clamping member is connected on the pipe, and the pipe is secured on an outer periphery of an opening of the container through the clamping member; a holding member is connected on the pipe and is configured to hold the tube of the concentration controller; the pulse bubble generator is connected to an air filter to filter the air, and the filtered air is pumped through the pipe into the detergent with a pulse per time, and the pulse bubble generator together with the air filter is directly secured on the concentration controller.

2. The cleaning apparatus for concentration controller of coating machine of claim 1, wherein the support is a cylinder support.

* * * * *